United States Patent [19]

Alford et al.

[11] 4,146,434

[45] Mar. 27, 1979

[54] PROCESS FOR THE DESULFURIZATION OF PETROLEUM COKE

[75] Inventors: Harvey E. Alford, Amherst, Ohio; Edward N. Marsh, South Laguna, Calif.

[73] Assignee: Standard Oil Company (Indiana), Cleveland, Ohio

[21] Appl. No.: 684,344

[22] Filed: May 7, 1976

Related U.S. Application Data

[63] Continuation-in-part of Ser. No. 523,997, Nov. 15, 1974, abandoned.

[51] Int. Cl.[2] ..... C10B 57/00; C01B 31/04

[52] U.S. Cl. ..... 201/17; 201/42; 423/449; 423/461

[58] Field of Search ..... 201/17, 42; 423/449, 423/461, 445, 448

[56] References Cited

U.S. PATENT DOCUMENTS

| | | | |
|---|---|---|---|
| 2,693,999 | 11/1954 | Reed | 423/461 |
| 2,789,085 | 4/1957 | Rollman | 201/17 X |
| 3,158,566 | 11/1964 | Tyson | 201/17 X |
| 3,369,871 | 2/1968 | Hardy et al. | 201/17 X |
| 3,607,062 | 9/1971 | Sudduth | 201/17 X |
| 3,712,855 | 1/1973 | Allred | 423/461 X |
| 3,712,855 | 1/1973 | Allred | 201/42 X |
| 3,759,795 | 9/1973 | Oliver et al. | 423/461 X |
| 3,759,795 | 9/1973 | Oliver et al. | 201/17 X |
| 3,950,503 | 4/1976 | Spurs | 423/461 |
| 3,954,674 | 5/1976 | Reis | 201/17 X |

OTHER PUBLICATIONS

Desulfurizing of Petroleum Coke; Chemical Abstract 65:13617q.

*Primary Examiner*—Morris O. Wolk
*Assistant Examiner*—Michael S. Marcus
*Attorney, Agent, or Firm*—Evelyn R. Kosman; Herbert D. Knudsen; Larry W. Evans

[57] ABSTRACT

Delayed coke especially manufactured for use in graphite can be effectively desulfurized by calcining in a hydrocarbon fuel-fired calciner in the temperature range of 2700° F. to 2900° F. without adversely affecting the strength of the coke or the coefficient of thermal expansion of the graphitized coke.

6 Claims, No Drawings

PROCESS FOR THE DESULFURIZATION OF PETROLEUM COKE

This patent application is a continuation-in-part of co-pending patent application Ser. No. 523,997, filed Nov. 15, 1974 now abandoned.

This invention relates to a process for the desulfurization of petroleum coke produced by the process of delayed coking. More particularly this invention relates to the desulfurization of delayed coke especially manufactured for use in graphite by the process of calcining the coke in a hydrocarbon fuel-fired calciner at temperatures in the range of from about 2700° F. to 2900° F.

Crudes that are being processed in refineries today are substantially higher in sulfur content than they have been in the past. While petroleum distillates can be conveniently desulfurized by hydrogenation, the reduction of sulfur in coke to an acceptable level to produce a saleable product and to meet environmental standards set for stack emissions, presents a much more difficult problem. Several alternatives immediately become apparent as possible means for overcoming this problem.

The coker feed can be desulfurized, however, this is not only costly but there are indicatations that a greater proportion of the sulfur in the feed will remain in the coke even after calcining at normal temperatures (2500° F.). Therefore desulfurization of a high sulfur residual stock does not necessarily guarantee a low sulfur coke, and it is strongly indicated that the sulfur specifications cannot be met even after feed desulfurization.

A second option is to desulfurize the coke. A number of reported methods involve the use of reducing gases such as hydrogen or steam, and a number of methods involve chemical treatment which include aluminum chloride, manganous oxide and sodium sulfide. However, all of these methods have the same disadvantage of requiring an additional reactor to accomplish desulfurization, thereby increasing the cost of the coke substantially.

Unexpectedly we have found that raw petroleum coke and in particular coke produced by the process of delayed coking can be effectively desulfurized by calcining in the substantial absence of oxygen in a hydrocarbon fuel-fired calciner in the temperature range of from about 2700° to 2900° F., without adversely affecting the strength of the coke or the coefficient of thermal expansion of the graphitized coke. These are the properties most critical in electrode manufacture. It is further surprising that bulk coke having particle sizes with diameters of up to 2 inches or more can be readily desulfurized by this process. However desulfurization of coke particles above about 2 inches in diameter by this process becomes increasingly less attractive economically because of the length of time required for calcining.

Raw petroleum coke, or green coke as it is sometimes referred to[1], is normally calcined to remove volatiles and to increase its density so that on subsequent thermal treatment the release of volatiles and excessive shrinkage does not result in a product with too great a porosity or cause cracking of the baked carbon structure. For most purposes devolatilization and dehydrogenation are complete at about 2100° F.[2].

[1]Mantell, C. L. "Carbon and Graphite Handbook" Copyrite, John Wiley & Sons, 1968, p. 256.

Most petroleum coke used in carbon and graphite manufacture and in the aluminum industry is calcined in direct natural gas or oil-fired calciners.[3,4] The advantage of the gas or oil-fired units resides in their lower operating cost, aided by the fact that the gases driven off in calcining can be utilized in heating the retort so that power costs are virtually eliminated.[3] Examples of gas or oil-fired calciners currently being used for this purpose are the rotary calciner which is most frequently used, and the shaft or vertical calciner.[3,4]

A typical rotary calciner consists of a refractory lined steel shell, 150–200 feet in length with a diameter of 8–11 feet, and which rotates slowly on an incline. Raw coke of the proper size is fed in at the upper end of the calciner. The unit is fired with natural gas or oil at the opposite end so that the movement of coke is counter to the flow of hot gases.[3,4]

A shaft calciner on the other hand is a vertical retort with heat generated in adjacent combustion chambers. A typical retort has a cross section of about 1 by 3 feet and is 12 feet high. Raw coke, presized to about 1–2 inches mesh, is fed into the retorts through an air lock valve from storage bunkers located above the calciners. The coke is heated in the absence of oxygen and is not in contact with combustion products during calcination, which distinguishes the shaft calciner from the rotary kiln.[3,4]

Gas or oil-fired calciners are generally operated in the temperature range of from 2200° to 2500° F.[4], and desulfurization of the coke does not occur at these temperatures. Although small amounts of petroleum coke are calcined in electric calciners in the temperature range of 2500° to 3300° F., electric calcination is used principally for anthracite coal[4] where desulfurization is not a problem. Additionally, in electric calcination there is a tendency to graphitize some of the charge, and for economic reasons the product obtained is not used in graphitized products but is used principally for amorphous electrodes or baked carbon products employed in refractory applications where the high current carrying capacity of graphite is not required or economically justified.[4]

[2]Mantell, C. L. p. 156. [3]Mantell, C. L. p. 262. [4]Kirk-Othmer, "Encyclopedia of Chemical Technology", 2nd ed. vol 4, p. 169–171.

The instant process of desulfurizing delayed coke used in graphite manufacture by calcining the coke in hydrocarbon fuel-fired equipment in the temperature range of 2700° to 2900° F. has heretofore not been practiced. The product obtained by this process is a low sulfur coke which contrary to general beliefs retains the required physical characteristics necessary for producing high current carrying graphite, despite the high calcination temperatures employed.

The present method of desulfurization can be successfully applied to raw petroleum coke obtained from a partially desulfurized coker feed or to a high sulfur coke containing from about 1.5 to 6.0% of sulfur by weight. While this process can be advantageously applied to raw coke containing any level of sulfur concentration, generally this method cannot be economically justified for coke containing less than about 1% by weight of sulfur.

The present process is especially applicable to the desulfurization of delayed coke. Delayed coking is of universal interest for the production of needle coke which is particularly advantageous when used in the manufacture of graphite electrodes. Delayed coking is characterized as an essentially non-continuous batch type operation resulting in the destructive distillation of the coker feed. In the delayed coking process the charge material can be a great variety of stocks, and among the most desirable are slurry oil and decant bottoms from catalytic cracking operations. In the process of delayed coking, fresh feed is charged to the bottom of a fractionator along with recycle, and the combined stream is heated in a coking heater. The liquid-vapor mixture leaving the coking heater is passed to a preheated, insulated coke drum to coke by contained heat. Coke accumulates in the drum in a quiescent pool and is maintained without agitation under time-temperature conditions. As the coking commences, the volatiles evolved are taken overhead for recovery in the fractionator, and the higher boiling components are recycled to the coker. Usually two or more coking drums are operated in parallel, coking taking place in one drum while a decoking operation is carried out in the other. It is the coke produced by this process that the desulfurization process described herein is particularly applicable.

Cokes treated in accordance with the present process generally can be desulfurized to about the same sulfur level irrespective of the initial sulfur concentration in the coke. Although beneficial results are obtained by calcination at temperatures as low as 2700° F., maximum benefits are realized in the temperature range of 2750° to 2850° F. Temperatures above about 2850° F., however, approach the maximum temperature limitation for hydrocarbon fuel-fired units. The calcination is conducted in the substantial absence of oxygen under an atmosphere of gaseous combustion products derived from the combustion of volatiles released from the coke or from the fuel employed.

Rate of desulfurization is dependent upon the initial sulfur content of the coke, and rate as well as degree of desulfurization are dependent to some extent upon the ash content of the coke because of the formation of thermally stable sulfides with the metals in the ash. The calcination time required for desulfurization therefore may vary widely, and calcination times ranging from about 15 minutes to about 5 hours may be advantageously employed. Calcination times of from 1 to 4 hours, however, are most preferred.

Coke yields in this process are equivalent to those obtained at the lower calcination temperature normally used in calcining, and are a function of the amount of volatile components in the coke and not of the calcination temperature. Similarly, multistage calcination does not affect yield, however, the sulfur level in the calcined product is higher with multistage calcination than with a single stage calcination at the desired temperature. This is contrary to the teachings in the reference Kalinowsky, B. Przem Chem.47 (6), 351-3 (1968), that a two-stage thermal desulfurization initially at 2200°-2400° F., followed by temperatures of 2700°-2900° F. is essential to maximize sulfur removal.

Although there are indications from the measurements of certain physical properties such as bulk and mercury displacement densities and open pore volume, that some change in coke structure does take place at the higher calcination temperature employed in the present process, there is no apparent adverse effect on hardness, as measured by abrasion resistance, and the coefficient of thermal expansion of the graphitized electrode prepared from coke calcined at 2800° F. which are the important properties affecting quality in the manufacture of graphite electrodes.

The effect of process conditions on the physical properties and the degree of sulfur removal from raw petroleum coke is illustrated by the following specific examples.

Examples

In the experiments summarized in Tables 1 to 4, calcining of the raw petroleum coke produced by delayed coking was conducted in a small Lindberg Hevi-Duty furnace under an atmosphere of argon. The normal charge of raw coke was approximately 5 grams and had a U.S. mesh size of 20 × 100 mesh. The coke was placed in a small alumina boat, the boat inserted in the horizontal tube furnace which was brought to temperature rapidly. The coke charge was held at the indicated temperature for three hours, and the sulfur content was determined thereafter by x-ray analysis.

The effect of desulfurization of vacuum residual coker feed as a means for reducing the sulfur level in the coke is shown by the data summarized in Table I. In this study the ratio for the percent of sulfur in the raw coke to the percent of sulfur originally in the vacuum residual coker feed is compared for cokes obtained from a Mid-Continent, a Light Arabian and a Light Iranian crude source and a desulfurized Light Arabian coker feed. The Light Arabian coker feed, containing 3.92 weight percent sulfur initially, was desulfurized by hydrodesulfurizing at a temperature of 750° F. and a pressure of 1700 psig. 750 Cubic ft/bbl of hydrogen were consumed and the sulfur content in the desulfurized coker feed was reduced to 0.70 sulfur by weight. Coking of the vacuum residual coker feeds was carried out at approximately 900° F. and the resulting raw coke obtained therefrom was subsequently analyzed for sulfur content by x-ray. The data in Table I show that by desulfurizing the coker feed, Example 3, proportionately more of the sulfur remains in the coke.

TABLE I

| Example No. | Vacuum Residual Coker Feed | % S in Raw Coke/% S in Vacuum Residual Coker Feed |
|---|---|---|
| 1 | Mid-Continent | 1.67 |
| 2 | Light Arabian | 1.43 |
| 3 | Light Arabian (Desulfurized Vacuum Residual) | 2.45 |

Accordingly, in order to obtain a raw coke sulfur of 1.64% which is generally obtained from a Mid-Continent vacuum residual coker feed containing 0.97% sulfur, it would be necessary to desulfurize the high sulfur Light Arabian vacuum residual feed to a level of 0.67%.

The effect of calcining temperatures on the desulfurization of raw coke is shown by the data summarized in Table II.

TABLE II

| Example No. | Calcination Temperature,° F. / Raw Coke Crude Source | Raw coke | 2500 | 2600 | 2700 | 2800 | 2900 |
|---|---|---|---|---|---|---|---|
| | | Weight % Sulfur | | | | | |
| 4 | Light Arabian (Desulfurized vacuum residual) | 1.72 | 1.74 | 1.70 | 1.34 | 0.93 | — |
| 5 | Light Arabian | 5.61 | 1.62 | — | — | 0.80 | 0.67 |
| 6 | Light Arabian | 4.24 | 2.41 | — | — | 0.95 | 0.88 |
| 7 | Mid-Continent A | 1.64 | 1.55 | — | — | 0.89 | — |

TABLE II-continued

| Example No. | Calcination Temperature,° F. Raw Coke Crude Source | Raw coke | 2500 | 2600 | 2700 | 2800 | 2900 |
|---|---|---|---|---|---|---|---|
| | | Weight % Sulfur | | | | | |
| | B | 1.79 | 1.58 | — | — | 1.01 | — |
| | C | 3.77 | 3.01 | — | — | 0.69 | — |

The data show that except for the high sulfur raw cokes, Examples 5 and 6, there is little change in sulfur content when calcined at 2500° F., the temperature at which petroleum cokes are generally calcined, while a significant decrease in sulfur content for all of the cokes is observed after calcination at 2800° to 2900° F. The data also show that the sulfur retained by all of the cokes tends to approach the same level, regardless of the sulfur content of the raw coke. It has also been observed that a greater degree of desulfurization is obtained with raw cokes of high ash content at the higher calcination temperatures.

The effect of calcining temperature on coke yield is demonstrated by the data shown in Table III. The data show that yield is independent of temperature of calcination and is dependent upon the volatiles present. The effect of time and temperature of calcining on yield and sulfur removal is shown in Table IV, and the data show that 1½ hours at a specific calcination temperature appears to be equivalent to 3 hours of calcination time with respect to both yield and sulfur content of the coke.

TABLE III

| Example No. | Calcination Temp.° F. Raw Coke Crude Source | 2500 | 2600 | 2700 | 2800 | 2900 |
|---|---|---|---|---|---|---|
| | | Weight % Yield | | | | |
| 8 | Light Arabian (Desulfurized Vacuum Residual Coker Feed) | 93 | 88 | 90 | 88 | — |
| 9 | Light Arabian | 84 | — | 84 | — | 84 |
| 10 | Light Iranian | 86 | — | — | 86 | 88 |
| 11 | Mid-Continent | | | | | |
| | A | 93 | — | — | 91 | — |
| | B | 64 | — | — | 71 | — |
| | C | 90 | — | — | 88 | — |

The data in Table IV also substantiate the fact that a single calcining temperature is superior to a multi-temperature calcining cycle. Using coke obtained from a desulfurized Light Arabian vacuum residual product, the following results were obtained:

TABLE IV

| Example No. | Time, Hrs. | Calcination Temp.,° F. | Wt.% Yield | Wt.% Sulfur |
|---|---|---|---|---|
| | Raw Coke | — | — | 1.72 |
| 12 | 1.5 | 2500 | 92 | 1.63 |
| 113 | 3 | 2500 | 91 | 1.71 |
| 14 | 1.5 | 2800 | 90 | 1.09 |
| 15 | 3 | 2800 | 88 | 0.93 |
| 16 | 1.5 | 2500 | 91 | |
| | 1.5 | 2800 | | 1.24 |

The effect of the use of higher calcining temperatures (2800° F.) on the physical properties of the coke as compared with the properties of coke calcined at the standard temperature of 2500° F. is shown by the data summarized in Tables V, VI and VII. Essentially all of the calcining of the cokes shown in Tables V and VI was done on coke derived from a Light Iranian vacuum residual which was coked in a pilot plant delayed coker. The calcining was carried out in a batch, fixed-bed pilot plant vertical tube Despatch furnace using a 600-gram charge. A nitrogen atmosphere was maintained in the calciner, and all cokes were calcined at the specific temperature indicated for a period of three hours.

Surprisingly, these data show that the strength of the coke as measured by abrasion resistance in three different types of abrasion tests is not affected by calcination at the higher temperature, nor does the higher calcination temperature have any effect on the quality of the electrodes prepared from these cokes as demonstrated by the most critical property, the coefficient of thermal expansion (CTE).

The effect of calcination at 2800° F. on the abrasion resistance of the coke is shown by the data given in Table V. Three different hardness (abrasion resistance) tests were run on both raw and calcined coke. Each hardness test had its own particular mode of abrasion. These included: (a) the Paint Shaker Hardness Test where abrasion is achieved primarily by impact; (b) the Tumbling abrasion test where abrasion is achieved by the mild rubbing of one particle against another; and (c) the National Bureau of Standards abrasion test where abrasion occurs both by impact and rather severe rubbing.

The abrasion tests were conducted according to the following procedures.

Paint Shaker Hardness test consisted of shaking a 50-gram, 8–70 mesh, charge of the coke in a Red Devil® paint shaker for 30 minutes. Sieve analyses were run and average particle size was determined before and after the test. The % reduction in average particle size/mm was then calculated. The abrasion severity factor was calculated from the sum of % reduction in average particle size and the %-70 mesh.

Tumbling Abrasion Test was carried out by placing a 400-gram sample of the coke in a one-gallon metal container and rotating the container at 25 rpm for a specified period of time. Sieve analyses were then run and the %-70 mesh was calculated. All of the contents, including fine were then returned to the container and the procedure was repeated for the next period of time indicated.

The National Bureau of Standards Test utilized was that reported in *National Bureau of Standards Quarterly Report,* No. 39, July-Sept., 1955, pp. 4–29.

The data show that raw coke obtained from a Light Iranian vacuum residual is less subject to abrasion than calcined coke; and in the most severe of the abrasion resistance tests (National Bureau of Standards) the abrasion resistance for the cokes calcined at the standard temperature 2500° F. and at 2800° F. are equivalent. In the Paint Shaker Hardness test the coke calcined at 2800° F. is shown to be even slightly more abrasion resistant than the standard.

As a final measure of whether calcining temperature has any effect on the quality of the coke, electrodes were prepared by pulverizing the calcined coke, mixing the coke with coal tar pitch, and subsequently extruding, baking and graphitizing the electrodes. The raw coke used in preparing these electrodes was made in the refinery from a highly aromatic feed stock. The coke obtained was representative of a special coke used in making graphite electrodes for the steel industry. The raw coke was calcined at 2500° F. and 2800° F. and the same reduction in sulfur at the higher calcination temperature was observed with the special coke as with the cokes previously described.

Electrodes were then prepared from the calcined cokes by pulverizing the coke so that 100% passed through 65 mesh and 50–60% passed through 200 mesh; mixing in a sigma blade mixer, 500 grams of the calcined coke with 175 grams of pulverized medium coal tar pitch (Allied Chemical, Grade 30) at a temperature of 285°–293° F. for 5 minutes; adding 8 mls of oleic acid dropwise; and continuing the mixing for 12 minutes. The mixture was then cooled to room temperature, pulverized and extruded at a die head temperature of 302° F. at a pressure of 1000–2000 psig.

The extruded rods were packed in a sagger in a vertical position in clean, dry silica sand and ½" of coke fines was placed over the top of the rods. The rods were then heated under an inert atmosphere to 1472° F. at a rate of 0.5° F. increase per minute; held at this temperature for two hours; then cooled in place to 200° F. and removed from the furnace.

The rods were graphitized by heating under an inert atmosphere to a temperature of 4800° F. by increasing the temperature at a rate of 52° F. per minute; held at this temperature for one hour, then cooled to room temperature. Coefficients of thermal expansion were then determined on the prepared electrodes in the temperature range of from room temperature to 210° F. using a Netzsch dilatometer.

The data summarized in Table VI indicate that calcination at the higher temperature (2800° F.) to desulfurize the coke does not have an adverse effect on the quality of electrode produced from such coke as compared with those prepared from coke calcined at the standard 2500° F.

Table V

| Example No.<br>Calcining Temperature, ° F. | 20<br>Raw Coke | 21<br>2500 | 22<br>2800 |
|---|---|---|---|
| National Bureau of Standards Test | | | |
| % Reduction/mm | 2.14 | 2.97 | 2.97 |
| %-70 mesh/mm | 1.06 | 1.10 | 0.77 |
| Abrasion severity factor | 3.20 | 4.07 | 3.74 |

Table V-continued

| Example No.<br>Calcining Temperature, ° F. | 20<br>Raw Coke | 21<br>2500 | 22<br>2800 |
|---|---|---|---|
| Paint Shaker Hardness Test | | | |
| % Reduction/mm | 0.72 | 1.44 | 0.53 |
| %-70 mesh/mm | 0 | 0.30 | 0.16 |
| Abrasion severity factor | 0.72 | 1.74 | 0.68 |
| Tumbling Abrasion Test<br>%-70 mesh | | | |
| 15 minutes | 0.02 | 0.17 | 0.27 |
| 30 minutes | 0.04 | 0.17 | 0.38 |
| 1 hour | 0.07 | 0.17 | 0.44 |
| 2 hours | 0.09 | 0.22 | 0.45 |
| 4 hours | 0.06 | 0.25 | 0.38 |

Table VI

| Example No.<br>Raw coke, wt. % sulfur | 21<br>1.73 | | 22<br>1.66 | |
|---|---|---|---|---|
| Calcining temperature, ° F. | 2500(1) | 2800(2) | 2500(1) | 2800(2) |
| Yield, wt. % | — | 92.7 | — | 94.5 |
| Sulfur, wt. % | 1.62 | 0.96 | 1.54 | 0.98 |
| % Feed sulfur removed | 6.4 | 44.5 | 7.2 | 41.0 |
| CTE × $10^{-7}$ | 2.83 | 2.81 | 5.86 | 5.57 |

(1)Plant calcined
(2)Pilot plant calcined (Despatch furnace)

We claim:

1. A process for desulfurizing petroleum coke for use in graphite manufacture comprising; conducting the calcining of the sulfur-containing bulk coke, having a particle size diameter of 2 inches or less, produced by the process of "delayed" coking in a single step by passing said bulk coke through a hydrocarbon fuel-fired calciner maintained in the temperature range of 2700° to 2900° F. for a period of 0.25 hours to 4 hours, and in the substantial absence of oxygen.

2. The process in claim 1 wherein the bulk coke is calcined in the temperature range of about 2750° F. to 2850° F.

3. The process in claim 2 wherein the calcining is conducted in an atmosphere of gaseous combustion products derived from the volatile components in the coke.

4. The process in claim 2 wherein the bulk coke is obtained from a partially desulfurized coker feed.

5. The process in claim 3 wherein the bulk coke is calcined for a period of about 1 to 4 hours.

6. The process in claim 5 wherein the calcination temperature is 2800° F.

* * * * *